US005514302A

United States Patent [19]

Brown

[11] Patent Number: 5,514,302

[45] Date of Patent: May 7, 1996

[54] FABRIC CLEANING SHAMPOO COMPOSITIONS

[75] Inventor: Colin W. Brown, Staines, Great Britain

[73] Assignee: S.C. Johnson & Son, Inc., Racine, Wis.

[21] Appl. No.: 211,532

[22] PCT Filed: Sep. 24, 1993

[86] PCT No.: PCT/US93/09088

§ 371 Date: Apr. 4, 1994

§ 102(e) Date: Apr. 4, 1994

[87] PCT Pub. No.: WO94/07980

PCT Pub. Date: Apr. 14, 1990

[30] Foreign Application Priority Data

Sep. 25, 1992 [GB] United Kingdom ..... 9220339

[51] Int. Cl.[6] ..... C11D 1/90; C11D 1/92; C11D 1/94; C11D 3/37

[52] U.S. Cl. ..... 252/545; 252/546; 252/174.15; 252/174.23; 252/174.24; 252/DIG. 2

[58] Field of Search ..... 252/174.15, 546, 252/174.23, DIG.2, 8.8, 174.24, 545; 8/137

[56] References Cited

U.S. PATENT DOCUMENTS

| | | | |
|---|---|---|---|
| 3,335,086 | 8/1967 | Morris | 252/89 |
| 3,630,919 | 12/1971 | Sheaffer et al. | 252/38 |
| 3,639,290 | 2/1972 | Fearnley et al. | 252/545 |
| 3,723,323 | 3/1973 | Morgan et al. | 252/90 |
| 3,723,358 | 3/1973 | Morgan et al. | 252/546 |
| 3,734,686 | 5/1973 | Douglas | 8/137 |
| 3,736,259 | 5/1973 | Buck et al. | 252/89 |
| 3,919,101 | 11/1975 | Anstett et al. | 252/90 |
| 3,987,227 | 10/1976 | Schultz | 428/91 |
| 4,013,595 | 3/1977 | Podella et al. | 252/545 |
| 4,035,148 | 7/1977 | Metzger et al. | 8/137 |
| 4,043,923 | 8/1977 | Loudas | 252/8.75 |
| 4,203,859 | 5/1980 | Kirn et al. | 252/174.23 |
| 4,269,739 | 5/1981 | Grejsner | 252/547 |
| 4,304,610 | 12/1981 | Weisensel | 134/21 |
| 4,447,349 | 5/1984 | Tai | 252/174.13 |
| 4,451,387 | 5/1984 | Tai | 252/174.15 |
| 4,469,848 | 9/1984 | Hooper et al. | 252/106 |
| 4,561,992 | 12/1985 | Troger et al. | 252/155 |
| 4,566,980 | 1/1986 | Smith | 252/8.6 |
| 4,599,189 | 7/1986 | Wuhrmann et al. | 252/174.15 |
| 4,609,750 | 9/1986 | Kollmeier et al. | 556/419 |
| 4,654,161 | 3/1987 | Kollmeier et al. | 252/174.15 |
| 4,659,494 | 4/1987 | Soldanski et al. | 252/88 |
| 4,678,595 | 7/1987 | Malik et al. | 252/174.17 |
| 4,780,100 | 10/1988 | Moll | 8/137 |
| 4,784,799 | 11/1988 | Petroff | 252/545 |
| 4,879,051 | 11/1989 | Lo et al. | 252/8.75 |
| 4,925,588 | 5/1990 | Berrod et al. | 252/174.23 |
| 5,073,442 | 12/1991 | Knowlton et al. | 428/267 |

FOREIGN PATENT DOCUMENTS 9407980 4/1994 WIPO .

*Primary Examiner*—Erin M. Harriman

[57] ABSTRACT

An improved aqueous fabric cleaning shampoo composition contains a combination of (a) about 0.5–20% by weight of a fabric cleaning polymer which is a solid at 25° C. and water dispersible or water soluble upon neuturalization with an alkaline compound such as a polymer of methacrylic acid/styrene/n-butyl acrylate, (b) about 0.1–10% by weight of a specific type of wax having a melting point of at least 50° C. such as pressure-emulsified polyethylene wax and (c) about 0.05–5% by weight of a silicone betaine polymer in addition to an effective amount of at least one conventional anionic, nonionic, amphoteric or zwitterionic surfactant in water at a pH of from about 7 to about 10.5. Such a fabric cleaning shampoo composition not only provides good cleaning and conditioning to fabrics, particularly synthetic fibre fabrics, such as those used in carpets as well as to upholstery and pile fabrics, but also provides soil resistance to the fabric cleaned with such a composition.

15 Claims, No Drawings

FABRIC CLEANING SHAMPOO COMPOSITIONS

TECHNICAL FIELD

This invention relates to an improved aqueous fabric cleaning shampoo composition containing a combination of a fabric cleaning polymer, a specific type of wax and a silicone betaine polymer in addition to at least one conventional surfactant to provide a fabric cleaning shampoo composition which not only provides good cleaning and conditioning to fabrics, particularly synthetic fibre fabrics, such as those used in carpets as well as to upholstery and pile fabrics, but also provides improved soil resistance to fabrics cleaned with such a composition.

BACKGROUND ART

Shampoo compositions for use on fabric materials such as carpets and upholstery have existed for a number of years. These types of products are used on fabrics that are large in size or fixed in place on furniture and thus cannot be easily removed from their current location for cleaning. In the case of carpets and rugs, these fabrics tend to receive high foot traffic and may get dirty rather quickly. Because of their size or location, such fabrics are not cleaned very often and thus it is beneficial to provide such fabrics with soil repellent treatments. Unlike articles of clothing that can be laundered in a clothes washing machine, the surfactants used to clean such fabrics cannot readily be rinsed from the fabric with water since the carpet or upholstery is fixed in place. Therefore there has been a constant desire to provide fabric cleaning compositions that can remove soil from carpets or upholstery with a minimum amount of water to speed drying of the fabric being cleaned while removing as much of the surfactants as possible since they tend to attract soil. Excess water can also cause shrinkage and warping of carpeting and may also promote mold growth. It is further desirable to have the cleaning composition impart anti-soiling properties to the fabric being cleaned to increase the time span between cleanings. Conditioning of the fabrics as a part of the cleaning process is also desirable.

Anti-soiling or soil repellency is described as the ability of a fabric such as a carpet to resist subsequent resoiling as a result of normal use such as foot traffic on carpets and ordinary use of furniture. It is a rough measure of the attraction or repulsion power of the products used to clean the fabric. Most carpeting and, often fabric furniture upholstery, is treated with a soil-resisting layer during the manufacture of the fabric or shortly before it is provided to the consumer. Examples of such treatments are the TEFLON® carpet treatment from E. I. Du Pont De Nemours & Company of Wilmington, Del., U.S.A. that is used in carpeting bearing the STAINMASTER® trademark and the SCOTCHGARD® products from 3M Company of St. Paul, Minn., U.S.A. which are used on both carpeting and fabric upholstery. Although these products render the fabric resistant to soiling, it is observed in many cases that the subsequent application of a shampoo fabric cleaning composition actively promotes the subsequent rate of resoiling of the cleaned fabric.

A number of attempts to provide shampoo fabric cleaning compositions have been made. U.S. Pat. Nos. 3,723,323 and 3,723,358 to Morgan et al. each describe aqueous fabric treating shampoo compositions containing anionic or nonionic surfactants as cleansing agents and neutralized polymers of acrylic or methacrylic acid with styrene or other unsaturated monomers such as alkyl acrylates and methacrylates. The polymer is said to impart anti-soiling properties to fabrics cleaned with the compositions. The composition is scrubbed into the fabric, allowed to dry, and then vacuumed away with the soil because the composition gets brittle and flakes away from the fabric fibres along with the soil upon drying. U.S. Pat. No. 4,013,595 to Podella et al. teaches non-flammable aqueous aerosol rug cleaners using hydrocarbon propellants. They possess reduced flammability due to the presence of at least 0.3% lauryl alcohol in combination with 0.3–10% of an alkali metal lauryl sulfate salt as at least one of the surfactants. The Podella et al. compositions also contain polymers of the type taught in the Morgan et al. Patents above.

U.S. Pat. No. 4,304,610 to Weisensel teaches a carpet cleaning method for use with extraction machinery to clean carpets that contain high foaming anionic surfactants. The aqueous liquid or dry powder composition contains a cationic surfactant that reacts with and suppresses foaming of the anionic surfactant in the carpet, a nonionic surfactant as a primary cleaning agent, builders, fillers and chelating agents, and optionally, optical brighteners, dyes and perfumes.

U.S. Pat. No. 3,734,686 to Douglas teaches a carpet cleaning shampoo composition for carpets and pile fabrics which is said to enhance the abrasion resistance and antistatic properties of the treated carpet or pile fabric. This benefit comes from the presence of an aqueous emulsion of oxygen-free polyethylene of particle size 0.02 to 0.5 microns and average molecular weight of 7,000–40,000 where at least 30% of the particles are covered with an emulsifier composition. The composition is said to possess increased foaming action and less force is needed to apply the shampoo to the carpet.

U.S. Pat. No. 5,073,442 to Knowlton et al. teaches a method of enhancing the soil resistance and stain resistance of polyamide and wool fabrics by treating them with a solution containing (1) the condensation product of formaldehyde with bis(hydroxyphenyl)sulfone, phenylsulfonic acid, dihydroxy(diphenyl)sulfone or benzenesulfonic acid; (2) a fluorochemical and (3) an acrylic polymer or copolymer. The compositions may also contain modified wax compositions such as paraffinic wax emulsions, microcrystalline wax emulsions or metalized wax emulsions. Acrylic polymers can be added to the compositions to reduce the discoloring effect of the phenolic resin on the fabric as well as to give the fabric a softer hand. The fluorochemical is said to improve the water and oil repellency of the treated fabric and also improves antisoiling properties. Knowlton et al. generally teach that silicones, fluorocarbons, waxes, acrylic polymers and combinations thereof have been used in repellent and antisoil finishes, but offer little or no protection against warm to hot liquid spills. This composition is primarily used as a treatment that is separate from normal cleaning operations.

U.S. Pat. No. 4,784,799 to Petroff teaches synergistic surfactant compositions that are a combination of alkylbenzenesulfonate anionic surfactants and at least one organic zwitterionic functional silicone surfactant such as a silicone sulfobetaine surfactant. The latter is a trimethylsiloxy-end-blocked polydiorganosiloxane composed of sulfobetaine(methyl)siloxy units and, optionally, dimethylsiloxy units. These compositions can be used in dishwashing detergents, liquid and powdered detergents and cleaners. Other examples of silicone polymers containing betaine-functional groups can be found in U.S. Pat. Nos. 4,609,750 and 4,654,161 to Kollmeier et al. These silicone polymers are said to be useful for cosmetic preparations, especially hair care products such as hair conditioners.

U.S. Pat. No. 4,269,739 to Grejsner teaches an agent for treating and cleaning records and similar objects that contains, in dissolved or emulsified form, from 0.001–1.2% of a natural or synthetic wax or wax-like substance, from 0.001– 2.5% of a fluid silicone oil with lubricating activity, 0.001–2.5% of a surface-active polysiloxane copolymer, 0.001– 1.2% of a fluorinated organic surfactant and 0.001–2.5% of a nonionic surfactant. It is used to clean and form an antistatic and lubricating coating on records and plastic articles such as photographic articles, optical lenses and television screens. All stated components are required and act synergistically. Nothing is taught concerning the use of such compositions in conjunction with cleaning fabrics.

U.S. Pat. No. 4,780,100 to Moll teaches a foaming aqueous aerosol fabric cleaning composition which has foaming surfactants, solvents, propellants, builders and water. The foam is said to enter the fabric pile and brings dirt up to the surface as a second foam is formed when the solvent evaporates. The only requirement for surfactants is that they form a foam and can include organosilicones. Amphoteric surfactants such as betaines can be used. Nothing is taught concerning the addition of polymer additives or waxes to these cleaning compositions.

U.S. Pat. No. 4,678,595 to Malik et al. teaches a carpet shampoo or upholstery cleaning composition containing a glycoside surfactant, a normally solid, water soluble or water dispersible polymer component and water. The composition is applied to a carpet, allowed to dry to form a non-tacky, friable film or polymeric residue and is then vacuumed away to remove the soil-containing residue. The polymers used can be butyl acrylate/styrene (optional)/methyl methacrylate/methacrylic, acrylic, and/or itaconic acid copolymers. Optionally, antistatic agents, foam builders and stabilizers such as amine oxides and amphoteric cycloimidines or imidazolines, optical brighteners, perfumes and the like can also be included.

U.S. Pat. No. 3,335,086 to Morris teaches soil anti-redeposition additives to prevent the redeposition of soil onto fabrics, clothes and the like while washing, shampooing, laundering and dry cleaning such articles. The additives are composed of a synergistic combination of carboxymethyl cellulose and a hydrolyzed polymer having a substantially linear hydrocarbon chain and both hydroxyl and carboxyl groups along the chain. These are then added to liquid or powdered detergent compositions to improve the anti-redeposition properties of the detergents.

U.S. Pat. No. 4,561,992 to Troger et al. teaches an aerosol cleaning agent for textile surfaces which contains plasticized urea-formaldehyde resin foam particles (0.005– 0.120 mm), propellant, antisettling agent, suspending agent, liquid and sodium aluminum silicate particles. A silicone defoamer may be included to promote the removal of soap residue. No moisture-retaining cationic antistatic agents are said to be needed. The product is applied to textile upholstery, allowed to dry and vacuumed away from the fabric. The cleaning agent is the sodium aluminum silicate particles.

The following further represent the state of the art. Additional aqueous liquid carpet and fabric cleaners are taught in U.S. Pat. Nos. 3,630,919 to Sheaffer et al.; 3,639,290 to Fearnley et al.; 3,736,259 to Buck et al.; and 3,919,101 to Anstett et al. A surfactant-free carpet cleaning and soil repellent composition is taught in U.S. Pat. No. 4,035,148 to Metzger et al. Dry powder carpet cleaners are taught in U.S. Pat. Nos. 4,659,494 to Soldanski et al. and 4,566,980 to Smith. Treatment compositions for textiles based upon fluorochemical compounds are taught in U.S. Pat. Nos. 3,987,227 to Schultz and 4,043,923 to Loudas. Acrylic polymers for use in carpet shampoo compositions are taught in U.S. Pat. Nos. 4,203,859 to Kirn et al. Anti-soiling and anti-redeposition polymer latices for use in conjunction with the aqueous washing of textile articles are taught in U.S. Pat. No. 4,925,588 to Berrod et al. Wax-containing compositions for use in conjunction with detergents for textiles are taught in U.S. Pat. Nos. 4,447,349 to Tai; 4,451,387 to Tai; and 4,599,189 to Wuhrmann et al.

SUMMARY DISCLOSURE OF THE INVENTION

One object of the present invention is to provide an aqueous shampoo composition for fabrics of the type used for carpets, rugs and upholstery and pile fabrics that are cleaned in place. These compositions are particularly useful for fabrics made from synthetic fibres. These compositions are especially useful for fabrics which have already been pre-treated with soil-resisting products. These compositions have good cleaning properties and also leave the cleaned fabric with greatly improved resistance to soiling as well as with a conditioned feel. The combination of carpet cleaning polymer, wax and silicone betaine described below produces a composition with properties that are much better than is seen with the use of any one of these components alone. The compositions are sprayed onto the fabric to be cleaned using an aerosol or a non-aerosol trigger sprayer, worked into the fabric, allowed to dry and then vacuumed away to remove soil and leave the fabric conditioned and treated with a soil repellent finish. Fabrics which have been pre-treated with a soil-repelling treatment that are cleaned with the compositions of the present invention have a reduced tendency for the cleaned fabric to resoil relative to other conventional shampoo fabric cleaning compositions. Since dirt particles may be hard and have sharp edges, the presence of dirt can damage the fibre by abrasive action. Thus, a product which reduces the amount of dirt associated with the carpet fabric may prolong the life of a carpet by reducing wear due to the abrasive action of dirt within the fibres.

These and other objects and advantages of the present invention are provided by an improved carpet shampoo composition which leaves a powdery product which can be vacuumed away when dry comprising an effective amount, preferably from about 0.5–20%, more preferably from about 0.5–10%, and most preferably 0.5–4%, by weight of the total composition, of at least one surfactant selected from the group consisting of anionic, nonionic, amphoteric and zwitterionic surfactants, preferably from anionic, amphoteric and zwitterionic surfactants, which are suitable for shampooing a carpet and being substantially vacuumed away when dry which surfactant is dispersed in water at a pH of from about 7 to 10.5, preferably from about 8.5–9.5, wherein the improvement comprises a) from about 0.5 to about 20% by weight of the total composition, more preferably from about 0.5–10%, and most preferably from about 0.5–4%, of a fabric cleaning polymer which is normally solid at 25 C. and is water soluble or water dispersible upon neutralization with an alkaline compound such as a polymer of methacrylic acid/styrene/n-butyl acrylate;

b) from about 0.1 to about 10%, preferably from 0.5– 2%, by weight of the total composition of wax, preferably as particles derived from an aqueous emulsion, selected from the group consisting of a synthetic wax, a natural wax or a wax-like synthetic organic substance having a melting point of at least 50° C., preferably a pressure-emulsified oxidized polyethylene wax; and c) from about 0.05% to about 5%, preferably from 0.25–0.5%, by weight of the total composition of a compatible silicone betaine polymer.

BEST MODE FOR CARRYING OUT THE INVENTION

The aqueous shampoo compositions of the present invention require the presence of at least one surfactant and water in addition to the three ingredients that provide the improved properties possessed by the compositions of the present invention. Deionized water or low mineral content, soft water is preferred. The percentages given herein are based upon non-volatile solids (actives) content ("NVM") unless otherwise specified.

The surfactants useful are an effective cleaning amount, typically from 0.5% to 20% by weight of the total shampoo composition, of any anionic, nonionic, amphoteric or zwitterionic surfactant that is useful in carpet shampoo compositions and being substantially vacuumed away when dry when combined with a carpet cleaning polymer of the type described below. Examples of such surfactants are given in U.S. Pat. Nos. 3,723,323 and 3,723,358 to Morgan et al. noted above. The anionic, amphoteric and zwitterionic surfactants are more preferred. Preferably from about 0.5–10% by weight of the total composition, and more preferably from about 0.5– 2% of the composition is composed of such surfactants. Use of more than the minimum amount of surfactant needed to remove the soil in a fabric is undesirable since surfactant residues left in the fabric, particularly those which are nonionic, tend to attract soil and dirt to the cleaned fabric and thus reduce the antisoiling effect of the compositions of the present invention.

Examples of suitable synthetic organic anionic surfactants are alkyl glyceryl ether sulfonates; alkyl sulfonates; alkyl monoglyceride sulfates or sulfonates; alkyl polyethoxy ether sulfonates; alkyl aryl sulfonates; acyl sarcosinates; acyl esters of isethionates; alkyl esters of sulphosuccinic acid; and alkyl phenol polyethoxy sulfonates. In these compounds, the alkyl and the acyl groups, respectively, contain 10 to 20 carbon atoms. They are used in the form of water soluble salts, for example, sodium, potassium or ammonium salts. Specific examples of the anionic organic surfactants are sodium lauryl sulfate, sodium dodecyl sulfonate, sodium alkylolamide sulphosuccinate and sodium N-lauroyl sarcosinate.

Examples of nonionic synthetic surfactants are polyethylene oxide condensates of alkyl phenols wherein the alkyl group contains from 6 to 12 carbon atoms and the ethylene oxide is present in a molar ratio of ethylene oxide to alkyl phenol in the range of 10:1 to 25:1; condensation products of ethylene oxide with the product resulting from the reaction of propylene oxide and ethylene diamine wherein the molecular weight of the condensation product ranges from 5,000 to 11,000; the condensation product of from about 5 to 30 moles of ethylene oxide with one mole of a branched or straight-chain aliphatic alcohol containing from about 8 to 18 carbon atoms; trialkyl amine oxides and trialkyl phosphine oxides wherein one alkyl group ranges from 10 to 18 carbon atoms and two alkyl groups range from one to three carbon atoms.

Examples of amphoteric and zwitterionic surfactants are organic alkyl betaines, alkyl sulfobetaines, alkyl aminocarboxylic acids and the like containing at least one long chain alkyl group of from about 8 to 22 carbon atoms. Organic alkyl betaines include cocamidopropyl betaine, cocamidoethyl betaine, isostearamidopropyl betaine, oleamidopropyl betaine, lauramidopropyl betaine, coco-betaine, and the like. Coco-sultaine is an example of a zwitterionic surfactant. Cocamidopropyl betaine is presently preferred.

As is known from the Morgan et al. Patents noted above, the fabric cleaning polymer component of the present invention is from about 0.5% to about 20% by weight of the total composition, more preferably from about 0.5% to 10%, and most preferably from about 0.5–2%, of an addition polymer comprising a major proportion of at least one unsaturated monomer whose homopolymer has a glass transition temperature ($T_g$) of at least 65° C. such as methyl methacrylate ($T_g$ typically 105° C.), ethyl methacrylate ($T_g$ typically 65° C.), cyclohexyl methacrylate ($T_g$ typically 66° C.), isobornyl methacrylate ($T_g$ typically 110°–170° C.), and styrene ($T_g$ typically 100° C.) plus additional monoethylenically unsaturated monomers of various $T_g$ values to modify the hardness and viscosity of the resulting polymer. Examples of such monomers, including the aforementioned, are the lower alkyl acrylates containing from 4 to 14 carbon atoms such as ethyl acrylate, n-propyl acrylate, n-butyl acrylate, isobutyl acrylate, hexyl acrylate, octyl acrylate and decyl acrylate, acrylonitrile, methacrylonitrile, alpha-methyl styrene, alkyl methacrylates containing from 5 to 15 carbons such as octyl methacrylate, and 1-alkenes having from 2 to 30 carbon atoms and the like. Such monomers are used to modify the overall $T_g$ of the polymer obtained which should typically have a $T_g$ of at least 25° C. so that it is a solid at room temperature, and more preferably, an overall $T_g$ of at least 65° C.

To provide water dispersability or solubility to the polymer, a minor amount of the polymer, generally from about 2% to 40% of the total polymer, is composed of a polymerizable monoethylenically unsaturated monomer containing free carboxyl groups such as acrylic acid, methacrylic acid, itaconic acid, maleic acid, and maleic anhydride with methacrylic acid presently being more preferred. The weight average molecular weight of the polymer can range from about 2,000 to 500,000 although a weight average molecular weight of about 20,000 to about 400,000 is more preferred with the carboxylic acid content being adjusted relative to the molecular weight of the polymer so as to provide a water dispersible or water soluble polymer. These types of polymers are well known in the art as can be seen from an examination of the Morgan et al. U.S. Pat. Nos. 3,723,323 and 3,723,358 noted above. Presently, polymers of methacrylic acid/styrene/n-butyl acrylate, which may optionally further contain alpha-methyl styrene, added as an aqueous emulsion are preferred.

As taught in the Morgan et al. U.S. Pat. Nos. 3,723,323 and 3,723,358 noted above which are hereby incorporated by reference to teach such polymers, the polymer should be present as at least 10% of the polymer-surfactant mixture and the weight ratio of polymer to surfactant should be from about 0.1 to 1 to 1:1. It will be understood that the specific weight ratio of the polymer to surfactant will depend upon the polymers and surfactants selected as well as the desired ultimate physical characteristics of the shampoo composition.

An effective amount of the carboxyl groups present in the polymer, preferably from about 80% to 100% of the stoichiometric amount, are neutralized to an alkaline pH to render the polymer water dispersible or water soluble. Such neutralization can be done with an alkaline neutralizing agent such as an organic base such as amino alcohols such as triethanolamine, 2-amino-2-methyl-1-propanol, and 2-amino-2-methyl- 1,3-propanediol and organic amines of from 2 to 22 carbon atoms such as triethylamine and laurylamine, or inorganic bases such as ammonium hydroxide, sodium hydroxide, potassium hydroxide, sodium carbonate, and the like. The pH of the shampoo composition is adjusted to from about 7 to 10.5 and more preferably, from about 7.5 to 8.5 for non-aerosol trigger sprayer compositions and about 9.5 to 10.5 for aerosol spray compositions.

Another required component of the present invention is from about 0.1% to about 10%, more preferably from about 0.1% to about 5%, and most preferably from 0.5–2%, by weight of the total composition of a wax selected from the group consisting of a synthetic wax, a natural wax or a wax-like synthetic organic substance having a melting point of at least 50° C. and more preferably at least 100° C. Examples of such waxes are carnauba wax, paraffin wax, polyolefin waxes, modified polyethylene waxes such as oxidized polyolefin waxes such as oxidized polyethylene, maleinized polyethylene and acrylated polyethylene waxes, micro-crystalline waxes, oxidized micro-crystalline waxes, montan wax and the like. These waxes are well known in the art and are commercially available from various manufacturers.

A hard wax such as a pressure emulsified polyethylene wax is presently preferred. Such waxes are commercially sold under the trade name AC Polyethylene AC 330 by Allied Chemicals of Morristown, N.J., U.S.A., which is an emulsifiable oxidized high density polyethylene containing some carboxyl groups and having a molecular weight of about 5,000, a Brookfield viscosity of 9,000 centipoise (9.000 pascal.second) at 140° C., an acid number (0.5 g/xylene/0.1N alcoholic sodium hydroxide, phenolphthalien indicator) of 25– 34 and a penetration value of 0.5 maximum (100 grams/5 s/25° C.). This wax can be emulsified in water using a base such as potassium hydroxide, a preservative and a small amount of a nonionic surfactant. Another example of a hard polyethylene wax is AC Polyethylene AC 316A from Allied Chemicals which is a high density oxidized polyethylene pressure emulsified wax having a Mettler dropping point of 140° C., an acid number of 15–18 (milligrams of KOH per gram), a density of 0.98 grams/cubic centimeter at 25° C., Brookfield viscosity of 8,500 centipoise (8.500 pascal.seconds) at 150° C. and a hardness at 25° C. of less than 0.5 dmm.

Some other specific examples of waxes are AC 629 Polyethylene Wax from Allied Chemicals that is a low molecular weight, low density oxidized polyethylene that is softer than the AC 330 wax having a softening point of 104° C. (ASTM E-28), a hardness of 5.5 (ASTM D-5), a Brookfield viscosity of 200 centipoise (0.2 pascal.second) at 140° C., and an acid number of 16 (mg KOH per gram). EPOLENE® E10 Wax is an emulsifiable polyethylene wax having a ring and ball softening point of 106° C., penetration hardness of 3.0 (100 grams/5 seconds/25° C., tenths of a millimeter), acid number of 15, Brookfield viscosity (No. 3 spindle, 30 rpm) of 1,200 centipoise (1.2 pascal.second) and EPOLENE® E11, E12, E14, E 15, and E20 Waxes are polyethylene waxes in the same family as EPOLENE® E10 Wax. EPOLENE® E43 Wax is an emulsifiable polypropylene wax having a weight average molecular weight of 9,100 (gel permeation chromatography), ring and ball softening point of 157° C., penetration hardness of <0.5 (100 grams/5 seconds/25° C., tenths of a millimeter), acid number of 47, Brookfield viscosity (No. 3 spindle, 30 rpm) of 0.350 centipoise (0.35 pascal.second) at 125° C. The EPOLENE® waxes are from Eastman Chemical Products, Inc. of Kingsport, Tenn., U.S.A. An example of an ester of montan wax is Hoechst Wax KLE from Hoechst AG of Middlesex, England having a dropping point of 79°–85° C., a viscosity of 22.60 mPa.s at 100° C. Hoechst PED 153 Wax from Hoechst AG is a fairly hard oxidized polyethylene wax having a dropping point of 120° C. (DGF-M-III 3 (75)). Other Hoechst waxes which may find use in the present invention are those sold under the designations PED 121, PED 136, PED 191, PED 261, PED 521 and PED 522.

Another required component of the present invention is from about 0.05% to about 5%, preferably from 0.25–0.5%, by weight of the total composition of a compatible silicone betaine polymer that is compatible with the other components present in the shampoo compositions of the present invention. Such polymers are known compositions and are described in U.S. Pat. Nos. 4,609,750 and 4,654,161 to Kollmeier et al. which are hereby incorporated by reference to teach such polymers and are commercially available from the assignee of the Kollmeier et al. patents, Th. Goldschmidt AG of Essen, Germany under the trademarks TEGOPREN® and ABIL®. Another type of silicone betaine, a silicone sulfobetaine polymer is described in U.S. Pat. No. 4,784,799 to Petroff noted above which is hereby incorporated by reference to teach such silicone sulfobetaine polymers.

The preferred silicone betaine polymers are of the Kollmeier et al. type having the general formula $$R^2(R^1)_2SiO((R^1)_2SiO)_x(R^2R^1SiO)_ySi(R^1)_2R^2$$

wherein $R^1$ can represent the same or different groups in the molecule and may be an alkyl radical with 1 to 18 carbon atoms, an aryl radical or a polyoxyalkylene radical with the proviso that at least 70% of the $R^1$ radicals are methyl radicals, $R^2$ may be the same as $R^1$ with the proviso that at least one $R^2$ radical is selected from one of the group consisting of (I)

$$—(CH_2)_3OCH_2CHR^3CH_2R^4 \text{ groups}$$

in which $R^3$ and $R^4$ are different, one radical representing a hydroxyl group and the other represents the $$—N^+R^5R^6(CH_2)_nCOO^- \text{ group}$$

in which $R^5$ and $R^6$ are the same or different and each represents an alkyl radical with 1 to 4 carbon atoms or a benzyl radical, and n=1, 2 or 3, and (II)

$$—R^7CONHR^8N^+R^5R^6(CH_2)_nCOO^- \text{ groups}$$

in which $R^7$ is a divalent alkylene radical with 2 to 12 carbon atoms and $R^8$ is a divalent alkylene radical with 2 to 6 carbon atoms, $R^5$, $R^6$ and n are as above, and each x has a value of from 0 to 200, and y has a value of from 1 to 50.

Specific examples of presently preferred polymers of these types are TEGOPREN® 6950 from Th. Goldschmidt that, according to the manufacturer, is a 30% NVM aqueous solution of a silicone betaine polymer having a molecular weight of about 2,500 and being of the general formula $$(CH_3)_3SiO(SiACH_3O)_m(Si(CH_3)_2O)_nSi(CH_3)_3,$$

wherein A has the formula $$—(CH_2)_3OCH_2CH(OH)CH_2N^+(CH_3)_2CH_2COO^-,$$

m and n are each greater than 0, the sum of m+n being such that the viscosity of the polymer at 25° C. is from about 50–

90 square meters per second, its specific gravity at 25° C. is from about 1.07 to 1.09 grams per cubic centimeter, and the Ross Miles foam height of the polymer at 0.1% solution in water 8 dH, at 25° C. is 80.

Th. Goldschmidt also sells this product under the name ABIL® B 9950 which, according to the manufacturer, is a 30% NVM aqueous solution of a silicone betaine polymer of the same general formula and with the same specific gravity value as the TEGOPREN® 6950, but reports a 1% solution of the polymer in water at 25° C. has a surface tension of 23–25 $mN.m^{-1}$. The manufacturer states that this polymer has been given the Cosmetics, Toiletry and Fragrances Association ("CTFA") designation of Dimethicone Propyl PG-Betaine.

To improve cleaning of oily dirt, from about 0.5% to about 15%, more preferably from about 2% to 5%, by weight of an organic solvent is optionally, but preferably, included within the compositions of the present invention. Examples of such solvents can be alcohols such as ethyl alcohol and isopropanol, glycol ether solvents such as propylene glycol monomethyl ether, propylene glycol n-butyl ether, dipropylene glycol monomethyl ether, tripropylene glycol butyl ether, dipropylene glycol n-butyl ether, dipropylene glycol dimethyl ether, ethylene glycol monoethyl ether, and ethylene glycol monobutyl ether as well as propylene carbonate.

In addition to the above required ingredients, minor amounts, typically less than 5% of the total composition, of conventional additives may be included as optional ingredients such as preservatives and antimicrobial agents such as IRGASAN® DP-300 (substituted diphenyl ether) from Ciba-Geigy Corporation, Dyestuff & Chemicals Division, Greensboro, N.C., U.S.A.; optical brighteners such as TINOPAL® CBS-X (distyrylbiphenyl derivative) and TINOPAL® 5BM-GX (stilbene derivative) from Ciba-Geigy; dyes; perfumes; stain-blocking agents such as ALGARD® RD (aromatic sulphonic acid condensate for use on nylon carpets as a stain repellent finish) and ALGARD® NS (aqueous solution of an aromatic sulphonic acid condensate) from Allied Colloids of Yorkshire, England and ZELAN® 338 (a 20–30% NVM aqueous solution of a carboxylated polymer salt) from E. I. Du Pont De Nemours & Co. of Wilmington, Del., U.S.A.; antiredeposition agents such as SOKALAN® HP22 (mixture of a nonionic surfactant and SOKALAN® CP5—sodium salt of a modified polyacrylic acid—and SOKALAN® CP9—sodium salt of a maleic anhydride/olefin copolymer) from BASF AG of Ludwigshafen, Germany; ultraviolet light absorbing compounds such as UVINUL® M-40 (2-hydroxy-4-methoxy benzophenone) and UVINUL® MS-40 (2-hydroxy-4-methoxy benzophenone-5-sulfonic acid) from BASF Corporation of Parsippany, N.J., U.S.A.; detergent builders such as borax; chelating agents and other oil/stain repellents such as fluorinated organic compounds such as ZONYL® 7950 Carpet Protector(30% NVM in isopropanol) and TEFLON® MF (TLF 5180) (72% NVM aqueous dispersion of polyaliphatic and polyfluoroaliphatic compounds) from E. I. Du Pont De Nemours & Co. of Wilmington, Del., U.S.A. These optional additives may be added provided that they are compatible with the shampoo compositions and do not materially detract from the desirable properties of the shampoo compositions of the present invention.

INDUSTRIAL APPLICABILITY

The aqueous fabric shampoo compositions of the present invention are low viscosity liquids which are typically less than 10 centipoise (0.010 pascal.seconds) in viscosity at 25° C. that are suitable for delivery by spraying. They are readily made simply by mixing the components together at room temperature or with slight heating to enhance dispersion. This is followed by adjusting the pH of the composition to the desired range of 7.0 to 10.5 with a suitable alkaline material. It is preferred that the wax compositions and the fabric cleaning polymer be added as aqueous emulsions to speed the incorporation of such materials into the composition being formed. Likewise, if a solvent is to be added, it can be used to dissolve more hydrophobic ingredients, with optional heating, such as waxes and antimicrobial agents before addition to the aqueous components.

The fabric shampoo compositions of the present invention may be used as prepared by placing the composition in a suitable applicator package such as a conventional trigger or pump sprayer bottle. Alternatively, the composition may be placed in a pressurizable container that is then pumped up with air to permit the contents to be dispensed under pressure in the form of a spray. The composition is then sprayed onto a carpet, rug or piece of upholstery which is to be cleaned. As is done with conventional shampoo compositions, the composition is worked into the fabric with a brush or other suitable applicator, allowed to dry and then the dry composition, which further contains the soil and dirt removed from the fabric, is vacuumed away.

If an self-pressurized aerosol formulation is desired, the shampoo composition can be charged into a pressurizable metal, glass or plastic container, sealed with a valve that is later fitted with an aerosol actuator button, and a propellant such as from about 3% to 20% of the total composition of a conventional propellant such as dimethyl ether or one or more saturated alkanes containing from 2 to 6 carbon atoms such as propane, isopropane, n-butane, isobutane, isopentane or n-hexane is added through the valve. Mixtures of two or more propellants can be used. Optionally, the propellant may be added before the valve is sealed onto the container. In the interests of ecology, the container may be pressurized with nitrogen, air or some other compressible inert gas. The actuator button is pressed by the user to atomize the shampoo composition into a spray which is then directed onto the fabric to be cleaned, usually in the form of a foam due to the presence of the propellant. If a foam is desired upon dispensing from the container, a volatile propellant such as n-butane should be used since the rapid evaporation of such propellants upon leaving the actuator button produces foaming.

The shampoo compositions of the present invention can be used in the same manner as have other conventional shampoo compositions to clean fabrics such as carpets, upholstery and pile fabrics with the further advantage that the fabric is not only cleaned, but is left conditioned with a soil repellent finish. It thus requires fewer cleanings than fabric treated with conventional shampoo compositions of this type.

The following Examples are provided to show various aspects of the present invention without departing from the scope and spirit of the invention. Unless otherwise indicated, all parts and percentages used are by weight.

In the following Examples, the "Soiling Capsule Test" for use in measuring the anti-resoiling properties possessed by fabrics cleaned with various fabric cleaning shampoos was run as follows: A section of white nylon carpet which has a factory-applied dirt repellent coating is cut into a 25 inch by 7.5 inch (63.5 cm by 19.05 cm) test piece. The test piece is divided into four, five or six equal sections. The shampoo compositions to be tested are applied in an even layer to one of the sections and scrubbed into the test piece by hand using a medical vinyl glove to protect the hand. One section is left untreated to act as a control or blank. The shampoo composition is allowed to dry at room temperature for 24 hours. The fabric is then vacuumed to remove the dried shampoo composition and soil. After drying and vacuuming, the fibres of the test piece are "fluffed up" by running the fingers of one hand through the fibres to separate them from adjacent fibres.

The test piece is then placed in a drum that forms the soiling capsule so that it lines the drum and the fibres of the test piece point inward towards the center of the drum. Twenty grams of powdered "soil" (previously filtered through a mesh having 1 millimeter openings) is added to the interior of the drum as well as a tetrahedrally arranged rubber-footed tetrapod that simulates walking on the test piece during the operation of the soiling capsule. The soiling capsule drum is then rotated at about 40 revolutions per minute for five minutes.

After five minutes the rotation of the soiling capsule drum is stopped and the test piece is removed. It is shaken free of loose soil and evaluated visually for the amount of soil retained by each section. If it appears necessary to remove loose dirt, the test piece may be vacuumed after removal from the soil capsule before evaluation. The condition of each section is then visually ranked on a 10 point scale where 10 is considered to be "totally clean" and 0 is "very dirty."

EXAMPLES 1–3

The following shampoo compositions illustrate carpet and fabric cleaning compositions in self-pressurized form that can be used for day to day maintenance. These compositions are intended to be used as a convenience product and for a light cleaning as well as an air freshening effect. The composition is simply sprayed onto the fabric, allowed to dry and vacuumed away without scrubbing the composition into the fabric. These compositions further contain a sanitizer (IRGASAN® DP-300) to reduce the level of bacteria in a fabric such as is found in a carpet to, for example, reduce odors.

| Example: | 1 | 2 | 3 |
|---|---|---|---|
| Deionized Water | 83.536 | 83.236 | 84.236 |
| Sodium Benzoate, flakes | 1.500 | 1.500 | 1.500 |
| Borax 10 mol | 0.500 | 0.500 | 0.500 |
| TINOPAL ® CBS-X | 0.002 | 0.002 | 0.002 |
| TINOPAL ® 5BM-GX | 0.002 | 0.002 | 0.002 |
| SDA-3A Ethyl Alcohol (95%) | 7.500 | 7.500 | 7.500 |
| IRGASAN ® DP-300 | 0.100 | 0.100 | 0.100 |
| Sodium Lauryl Sulfate (28%) | 1.500 | 1.500 | 1.500 |
| Sodium Lauryl Sarcosinate (30%) | 0.410 | 0.410 | 0.410 |
| REWOCOROS ® B 3010[1] | 0.500 | 0.500 | 0.500 |
| Rug Cleaning Polymer A[2] | 1.000 | 1.000 | 1.000 |
| AC 330 Wax Emulsion (28%)[3] | 1.500 | 1.500 | 1.500 |
| TEGOPREN ® 6950 (30%) | 0.250 | 0.250 | 0.250 |
| ZONYL ® 7950 (30%) | 0.500 | 0.500 | 0.500 |
| ALGUARD ® RD | 0.200 | — | — |
| ZELAN ® 338 | 0.500 | 1.000 | — |
| Fragrance | 0.500 | 0.500 | 0.500 |
| Total Intermediate: | 100% | 100% | 100% |
| To pH (used 50% aqu. KOH) | 10.5 | 10.5 | 10.5 |
| Final Composition: | | | |
| Above Intermediate | 85.000 | 85.000 | 85.000 |
| n-Butane (48 p.s.i.g. or 331 Pascal vapor pressure) | 15.000 | 15.000 | 15.000 |
| Total Composition: | 100% | 100% | 100% |

The percentages after the names are the actives content.

1. Alkenyl succinic acid, disodium salt from Rewo Chemisches Werke GmbH of Steinau, Germany.
2. Aqueous emulsion-polymerized polymer of methacrylic acid/styrene/n-butyl acrylate in a 35/55/10 weight ratio having 25% NVM.
3. Aqueous emulsion of 28% AC Polyethylene AC 330, 7% of a nonylphenolethoxylate (10 ethoxy groups average) nonionic surfactant, 0.2% of 37% formaldehyde, 1.4% of 50% aqueous potassium hydroxide solution, and 63.4% water having 35% NVM (2 grams/40 minutes/145° C.) and a pH of 8.5–9.5.

These compositions are made by mixing the ingredients together well with stirring in the order listed to form an intermediate composition and adjusted to pH 10.5 with 50% aqueous potassium hydroxide solution ("50% aqu. KOH"). This intermediate is then added to a conventional pressurizable aerosol container that is then sealed with a conventional aerosol valve. The container is filled through the valve with the indicated amount of n-butane and a conventional aerosol actuator button or an actuator/overcap is placed on the stem of the valve. The composition can then be dispensed onto a carpet or upholstery, worked into the fabric with a brush, allowed to dry and vacuumed away to leave a clean, conditioned fabric with improved resistance to resoiling.

EXAMPLES 4–7

The following shampoo compositions illustrate carpet and fabric cleaning compositions in self-pressurized form which can be used as deep cleaning aerosol compositions.

| Example: | 4 | 5 | 6 | 7 |
|---|---|---|---|---|
| Deionized Water | 84.296 | 83.996 | 84.996 | 78.781 |
| Borax 10 mol | 0.500 | 0.500 | 0.500 | 0.500 |
| Sodium Benzoate, flakes | 1.500 | 1.500 | 1.500 | 1.500 |
| TINOPAL ® CBS-X | 0.002 | 0.002 | 0.002 | 0.002 |
| TINOPAL ® 5BM-GX | 0.002 | 0.002 | 0.002 | 0.002 |
| DOWANOL ® DPM[1] | 2.000 | 2.000 | 2.000 | 2.500 |
| DOWANOL ® PM[2] | 2.000 | 2.000 | 2.000 | 2.500 |
| JONCRYL ® 90[3] (44%) | 1.000 | 1.000 | 1.000 | 4.330 |
| AC 330 Wax Emulsion (28%) | 1.500 | 1.500 | 1.500 | 1.570 |
| Sodium Lauryl Sulfate (28%) | 5.500 | 5.500 | 5.500 | 7.310 |
| REWOCOROS ® B 3010 | — | — | — | 0.500 |
| TEGOPREN ® 6950 (30%) | 0.250 | 0.250 | 0.250 | 0.255 |
| ZONYL ® 7950 (30%) | 0.500 | 0.500 | 0.500 | — |
| ALGUARD ® RD | 0.200 | — | — | — |
| ZELAN ® 338 | 0.500 | 1.000 | — | — |
| Fragrance | 0.250 | 0.250 | 0.250 | 0.250 |
| Total Intermediate: | 100% | 100% | 100% | 100% |
| To pH (used 50% aqu. KOH) | 10.5 | 10.5 | 10.5 | 10.5 |
| Final Composition: | | | | |
| Above Intermediate | 92.500 | 92.500 | 92.500 | 92.500 |
| n-Butane | 7.500 | 7.500 | 7.500 | 7.500 |
| Total Composition: | 100% | 100% | 100% | 100% |

1. Dipropylene glycol monomethyl ether from Dow Chemical Company of Midland, Mich., U.S.A.

2. Propylene glycol monomethyl ether from Dow Chemical.
3. Styrene/alpha-methyl styrene/acrylic acid polymer emulsion having 44% NVM (2 grams/40 minutes/145° C.), an acid value of the polymer of 65, a Brookfield viscosity of 200 mPa.s at 25° C., $T_g$ of 110° C., a weight average molecular weight of greater than 200,000 and a pH of 8.2 using ammonium hydroxide from Specialty Chemicals Mijdrecht B. V.—Polymers of Mijdrecht, the Netherlands, an associate company of S. C. Johnson & Son, Inc. of Racine, Wis., U.S.A.
4. Vapor pressure of 48 p.s.i.g. (331 Pascal).

These compositions are made by mixing the ingredients together well with stirring in the order listed to form an intermediate composition and adjusted to pH 10.5. This intermediate is then added to a conventional pressurizable aerosol container that is then sealed with a conventional aerosol valve. The container is filled through the valve with the indicated amount of n-butane and a conventional aerosol actuator button or actuator/overcap is placed on the stem of the valve. The composition can then be dispensed onto a carpet or upholstery, worked into the fabric with a brush, allowed to dry and vacuumed away to leave a clean, conditioned fabric with improved resistance to resoiling.

EXAMPLES 8–10

The following shampoo compositions illustrate carpet and fabric cleaning compositions useful for trigger sprayer application as spot and stain removers.

| Example: | 8 | 9 | 10 |
|---|---|---|---|
| Deionized Water | 84.650 | 84.350 | 85.350 |
| Citric Acid, Anhydrous | 0.400 | 0.400 | 0.400 |
| Sodium Carbonate | 0.500 | 0.500 | 0.500 |
| Rug Cleaning Polymer A | 3.000 | 3.000 | 3.000 |
| Surfactant Blend A (35%)[1] | 3.000 | 3.000 | 3.000 |
| TEGOPREN ® 6950 (30%) | 0.250 | 0.250 | 0.250 |
| AC 330 Wax Emulsion (28%)[3] | 1.500 | 1.500 | 1.500 |
| Fragrance | 0.500 | 0.500 | 0.500 |
| ZONYL ® 7950 (30%) | 0.500 | 0.500 | 0.500 |
| ALGUARD ® RD | 0.200 | — | — |
| ZELAN ® 338 | 0.500 | 1.000 | — |
| DOWANOL ® PM | 3.000 | 3.000 | 3.000 |
| Isopropanol, Anhydrous | 2.000 | 2.000 | 2.000 |
| Total: | 100% | 100% | 100% |
| To pH (used 10% aqu. NaOH) | 8.0 | 8.0 | 8.0 |

The percentages after the names are the actives content.

1. A 35% NVM blend of 13% sodium lauryl sulfate, 16% sodium alkylolamide sulphosuccinate, 65% water and the balance surfactants and salts.

These compositions are made by mixing the ingredients together well with stirring in the order listed to form the fabric cleaning shampoo composition and adjusted to pH 8.0 with 10% aqueous sodium hydroxide solution ("10% aqu. NaOH"). The composition is placed in a conventional trigger sprayer container. Although an entire area of fabric may be cleaned with this composition, it can also be used as a stain remover for small areas. The composition is sprayed onto a stain on a carpet or upholstery and allowed to remain on the stain for 2 minutes. The area sprayed is then rubbed with a damp cloth or a mop and allowed to dry. If desired, the cleaned area may be vacuumed. A clean, conditioned area of fabric with improved resistance to resoiling results.

EXAMPLES 11–12

The following shampoo compositions illustrate carpet and fabric cleaning compositions in self-pressurized form that can be used as deep cleaning aerosol compositions.

| Example: | 11 | 12 |
|---|---|---|
| Deionized Water | 75.493 | 78.812 |
| Borax 10 mol | 0.500 | 0.500 |
| Sodium Benzoate, flakes | 1.500 | 1.500 |
| Rug Cleaning Polymer A | 7.735 | — |
| JONCRYL ® 90 (44%) | — | 4.299 |
| REWOCOROS ® B 3010 | 0.500 | 0.500 |
| Sodium Lauryl Sulfate (28%) | 5.487 | 7.310 |
| TEGO-BETAIN ® L 7[1] | 1.706 | — |
| DOWANOL ® DPM | 2.500 | 2.500 |
| DOWANOL ® PM | 2.500 | 2.500 |
| TINOPAL ® CBS-X | 0.002 | 0.002 |
| TINOPAL ® 5BM-GX | 0.002 | 0.002 |
| AC 330 Wax Emulsion (28%) | 1.570 | 1.570 |
| TEGOPREN ® 6950 (30%) | 0.255 | 0.255 |
| Fragrance | 0.250 | 0.250 |
| Total Intermediate: | 100% | 100% |
| To pH (used 10% aqu. NaOH) | 9.5 | 9.5 |
| Final Composition: | | |
| Above Intermediate | 92.500 | 92.500 |
| n-Butane | 7.500 | 7.500 |
| Total Composition: | 100% | 100% |

[1]A 30% NVM solution of cocamidopropyl betaine from Th. Goldschmidt AG.

These compositions were made in the same manner as in the previous examples by combining the ingredients in order and then placing the compositions in aerosol containers as described in Examples 4–7. These compositions are designed for use as heavy duty cleaners that are sprayed on the fabric to be cleaned and scrubbed into the fabric with a sponge mop for best cleaning. The composition is allowed to dry and vacuumed away from the fabric.

EXAMPLE 13

In this Example, the performance of Examples 11 and 12 were tested by the Soiling Capsule Test and in actual exposure to foot traffic versus commercially available carpet shampoo compositions.

In the Soiling Capsule Test results described in Table I below, each block of results represents one soiling capsule carpet strip. The order of compositions listed from top to bottom in a block of four, five or six compositions represents the order in which the compositions were placed on the strip from left to right. The scoring was done visually on a scale of 0 to 10 where 0 was very dirty in appearance and 10 was totally clean in appearance:

TABLE I

| Composition | Score |
|---|---|
| WOOLITE ® Deep Clean[1] | 5 |
| Example 11 | 8 |
| BLANK | 5 |
| WOOLITE ® Tough Stain[1] | 6 |
| WOOLITE ® Self Cleaning[1] | 7 |
| RESOLVE ® Trigger Sprayer[3] | 4 |
| Example 11 | 8 |
| RESOLVE ® Aerosol[3] | 4 |
| BLANK | 8 |
| 1001 TROUBLESHOOTER[5] | 7 |
| PROFONDEUR[6] | 3 |
| PPZ[4] (Sample #1) | 2.5 |
| PPZ[4] (Sample #2) | 2 |
| BLANK | 5 |
| Example 11 | 6 |
| Example 12 | 6 |

TABLE I-continued

| Composition | Score |
|---|---|
| PROFONDEUR[6] | 3 |
| BLANK | 6 |
| Example 11 | 4 |
| PPZ[4] | 2 |
| GLORY ® Rug Cleaner[2] | 4 |
| Example 11 | 6.5 |
| RESOLVE ® Aerosol[3] | 1.5 |
| BLANK | 5 |
| PPZ[4] | 4 |
| Example 12 | 5 |
| PPZ[4] | 2 |
| Example 11 | 5 |
| GLORY ® Rug Cleaner[4] | 3 |
| BLANK | 6 |
| PROFONDEUR[6] | 1.5 |
| RESOLVE ® Aerosol[3] | 1 |
| Example 11 | 6 |
| BLANK | 4 |
| GLORY ® Rug Cleaner[2] | 5 |
| PPZ[4] | 4 |

[1]A product of Reckitt & Colman Household Products of Wayne, New Jersey, U.S.A.
[2]A product of S. C. Johnson & Son, Inc. of Racine, Wisconsin, U.S.A.
[3]A product of Lehn & Fink Products of Montvale, New Jersey, U.S.A.
[4]A product of Henkel Solitaire of Levallois, France.
[5]A product of PC Products (1001) Ltd of Kersal Vale, Manchester, England.
[6]A product of La Johnson Francaise S.A. of Cergy, France.

Table I shows that Examples 11 and 12 were at least as good and, in most cases, better in Soil Capsule Testing results for soil repellency after cleaning than the five other commercial products tested with these compositions.

To test for soil repellency under actual conditions of use in areas having heavy foot traffic, two 200 centimeter by 100 centimeter panels of white nylon carpeting were cut and marked into six sections. The following products were applied to the sections and then allowed to dry thoroughly. Each panel was then taped down in the corridor of a research building for a total of four weeks to permit exposure to the foot traffic in that corridor. Each panel was reversed in direction after two week's time to ensure even soiling of all sections. The results obtained after four weeks of heavy foot traffic are reported in Table II.

TABLE II

| Composition | Score |
|---|---|
| WOOLITE ® Deep Clean | 3 |
| BLANK | 6.5 |
| PROFONDEUR | 4 |
| Example 11 | 6 |
| WOOLITE ® Self Cleaning | 5 |
| RESOLVE ® Aerosol | 3.5 |
| WOOLITE ® Aerosol[1] | 3 |
| BLANK | 5 |
| PROFONDEUR | 3.5 |
| Example 11 | 6 |
| HURRA ® Alfombras[2] | 4 |
| HURRA ® Especial Tap.[3] | 2.5 |

[1]A product of Reckitt & Colman, St-Florent-Sur-Cher, France
[2]A product of Kanfort America S.A. of Martinez Campos, Madrid, Spain.
[3]HURRA ® Especial Tapicerias from Kanfort America S.A.

In this testing, Example 11 was the best in the second panel and was slightly more soiled than the blank in the first panel although it still did at least slightly better than the other compositions tested.

EXAMPLE 14

In this Example, the cleaning ability of self-pressurized aerosol foam Examples 11 and 12 were evaluated against commercially available self-pressurized aerosol foam carpet shampoo compositions of the types identified in Example 13.

To carry out this evaluation, a sample of white hessian-backed nylon carpet was soiled with 200 grams of an oil-based soil mixture composed of dirt taken from outside a research building, soil from the ground found near an auto garage, and oily synthetic soil. The components were thoroughly mixed and the stones were removed from the soil mixture. That soil mixture was sprinkled uniformly over the surface of the carpet to be tested and was impressed into it by walking and scuffing over the carpet sample for 5–10 minutes. The carpet was shaken free of loose particulate matter and then left for one day to settle before applying the shampoo compositions to be tested.

Each container of aerosol carpet shampoo composition was weighed initially and after each application of the composition to the soiled carpet sample to ensure that equal amounts of shampoo composition were applied to each test area. Each shampoo composition was, according to the use instructions provided, shaken well and then sprayed as a foam onto a marked section of the soiled carpet sample from a distance of 50–60 centimeters from the carpet sample. The foam was then worked into the pile of the carpet using a damp sponge. After visually assessing the ease of application, the carpet sample was then allowed to dry. The dry composition was then removed by vacuuming.

Each cleaned section of the carpet sample was then assessed visually for cleaning performance and conditioning using a scale of 1 to 5 where 1 represented very poor cleaning or very poor conditioning and 5 represented very good cleaning or effective conditioning.

Examples 11 and 12 were found to all have a greater foam volume and greater foam stability than the Henkel PPZ composition and were on par, if not marginally superior, to the PROFONDEUR composition. Example 11 produced the creamiest foam which proved to be slightly more difficult to rub into the pile on the carpet.

The compositions tested and their order of ranking from best to worst for cleaning efficiency on the carpet sample using the oil-based soil mixture were as follows:

Example 11 (best)

Example 12

PROFONDEUR

Henkel PPZ (worst)

The conditioning effect of each cleaning shampoo composition was also evaluated with the ranking being as follows:

Example 11/Example 12 (best-tie)

Henkel PPZ

PROFONDEUR (worst)

The same evaluation procedure was carried out using a "water-based" soil mixture which was simply 200 grams of soil from the ground near an auto garage without adding any oily soil as was done above. This water-based soil mixture was applied to the same type of nylon carpet sample as described above. The shampoo compositions were applied in the same manner as described above. In this test, two different samples of Henkel PPZ (PPZ1 and PPZ2) were used to compare the performance of each although both samples were purchased at the same time from the same store.

Henkel PPZ1 (best)

Example 11

Example 12

Henkel PPZ2

PROFONDEUR (worst)

The difference in performance of the Henkel PPZ1 and PPZ2 on the water-based soil mixture could not be explained. The individual numerical ratings of several tests using water-based soil mixtures were combined to obtain an overall performance rating. PPZ1 was the highest in these tests with an overall numerical score of 30 which was closely followed by Example 11 with a score of 28. Example 12 was next with an overall score of 24 followed by PPZ2 with a score of 19 points. PROFONDEUR was last with an overall score of 9. Examples 11 and 12 and PPZ1 were also more effective in conditioning the carpet sample than PPZ2 and PROFONDEUR.

EXAMPLES 15–23

In these Examples, the effect of substituting various types of waxes in the shampoo compositions of the present invention was explored using the Soiling Capsule Test.

A base composition was prepared having the following formulation: 76.351% deionized water; 0.500% borax 10 mol; 1.500% sodium benzoate; 0.500% REWOCOROS® B 3010; 4.330% JONCRYL® 90 (45%); 7.310% sodium lauryl sulfate; 2.500% DOWANOL® DPM; 2.500% DOWANOL® PM; 0.002% TINOPAL® CBS-X; 0.002% TINOPAL® 5BM-GX; 0.255 TEGOPREN® 6950 and 0.250% fragrance. This composition prepared by mixing the components together in the order listed followed by adjusting the pH of the composition to 9.5 with 50% aqueous potassium hydroxide solution to form "BASE A".

Examples 15 through 23 were made by mixing 96.000 parts by weight of BASE A with the following amounts of wax emulsions and deionized water:

Example 15: 1.705 parts of AC 330 Wax Emulsion (28%) and 2.295 parts of deionized water.

Example 16: 2.822 parts of an aqueous emulsion of Hoechst Wax KLE (19.47%) and 1.178 parts of deionized water.

Example 17: 2.822 parts of an aqueous emulsion of 17% Carnauba Wax, Light North Country, T-3 and 3% of a nonionic fatty alcohol polyglycol ether surfactant (MULSIFAN® RT 359 from Zschimmer & Schwartz of Lahnstein, Germany (total NVM of 19.47%) and 1.178 parts of deionized water.

Example 18: 2.753 parts of a mixture of 3.4% Carnauba Wax, Light North Country, T-3 (82.5°–85° C. melting point), 13.6% paraffin wax (minimum melting point 55°–57° C.) and 3% of MULSIFAN® RT 359 (total NVM of 19.96%) and 1.247 parts of deionized water.

Example 19: 1.657 parts of an aqueous emulsion of 22.9% AC 629 Wax and 8.3% LUTENSOL® ON70 surfactant from BASF AG (synthetic fatty alcohol with average of 7 ethoxy groups) (total NVM of 33.2%) and 2.343 parts of deionized water.

Example 20: 1.651 parts of an aqueous emulsion of 25.5% Hoechst PED 153 Wax and 6.4% LUTENSOL® ON70 (total NVM of 33.3%) and 2.349 parts of deionized water.

Example 21: 1.363 parts of an aqueous emulsion of 29.1% EPOLENE® E43 and 8.7% NEODOL® 25-9 surfactant from Shell Chemical Company of Houston, Tex., U.S.A. ($C_{12}$–$C_{15}$ linear primary alcohol ethoxylate) (total NVM of 40.31%) and 2.637 parts of deionized water.

Example 22: 1.633 parts of an aqueous emulsion of 13.4% EPOLENE® E10, 13.4% EPOLENE® E20, and 6.7% LUTENSOL® ON70 (total NVM of 33.65%) and 2.367 parts of deionized water.

Example 23: A control sample which just added 4.000 parts of deionized water to the 96.000 parts of BASE A.

The Soil Capsule Test performed used two panels of carpet containing six test areas on each. The results for each panel are reported below in Table III in the same fashion as was done in Example 13:

TABLE III

| Composition | Score | Composition | Score |
|---|---|---|---|
| Example 16 | 6 | Example 20 | 6 |
| Example 15 | 7 | Example 15 | 7 |
| Example 17 | 5 | Example 21 | 5.5 |
| Example 18 | 4.5 | Example 22 | 5 |
| BLANK | 3.5 | BLANK | 3 |
| Example 19 | 6.5 | Example 23 | 6.5 |

Thus the compositions containing various types of waxes were all improved over the untreated BLANK panel (10 is best in antiresoiling ability) with Example 18 containing soft paraffin wax in addition to carnauba wax being the lowest performer in this group. The compositions were all comparable to control Example 23 containing a polymer antiresoiling polymer with Example 15 being the best performer in this Test.

EXAMPLES 24–37

In this series of Examples, shampoo compositions were evaluated using the Soiling Capsule Test where the compositions contained less than all three of the required components of the present invention (fabric cleaning polymer, wax and silicone betaine polymer) as well as combinations of all three required components. Examples 24–33 are comparative examples.

An antistatic agent for textiles used in some commercially available carpet shampoo compositions that is sold by Rewo Chemische Werke GmbH of Steinau, Germany under the name REWOQUAT® CPEM was included in some of the formulations. REWOQUAT® CPEM is N-methyl-N-(pentaethoxy)-N-coco ammonium methosulfate at 100% NVM.

Examples 24–29 had the following formulations:

All of the Intermediates for Examples 24–29 contained 0.50% borax 10 mol; 1.50% sodium benzoate; 0.50% REWOCOROS® B 3010; 2.00% DOWANOL® DPM; 1.00% SDA-3A Ethyl Alcohol (95%); and 0.25% fragrance. In addition to these components, the Intermediate compositions further contained the following components listed as percentages present:

| Intermediate for Example: | 24 | 25 | 26 |
|---|---|---|---|
| Deionized Water | 78.11 | 76.75 | 73.48 |
| Rug Cleaning Polymer A | 8.22 | 8.04 | 9.51 |
| Surfactant Blend A (35%) | 6.95 | — | 8.04 |
| Sodium Lauryl Sulfate (28%) | — | 8.51 | — |
| STEINAQUAT ® CPEM (100%) | 0.97 | 0.95 | — |
| AC 330 Wax Emulsion (28%) | — | — | 3.22 |
| TEGOPREN ® 6950 (30%) | — | — | — |
| **Intermediate for Example:** | **27** | **28** | **29** |
| Deionized Water | 73.57 | 82.46 | 81.37 |
| Rug Cleaning Polymer A | 9.28 | 6.11 | 6.01 |
| Surfactant Blend A (35%) | — | 5.16 | — |
| Sodium Lauryl Sulfate (28%) | 8.26 | — | 6.36 |
| STEINAQUAT ® CPEM (100%) | — | — | — |

-continued

| | | | |
|---|---|---|---|
| AC 330 Wax Emulsion (28%) | 3.14 | — | — |
| TEGOPREN ® 6950 (30%) | — | 0.52 | 0.51 |

The Intermediates were prepared simply by mixing the components together in the following order with good stirring: water, borax, sodium benzoate, Rug Cleaning Polymer A, REWOCOROS® B 3010, Surfactant Blend A, sodium lauryl sulfate, DOWANOL® DPM, alcohol, STEINAQUAT® CPEM, AC 330 Wax Emulsion, TEGOPREN® 6950 and fragrance followed by adjusting the pH of each Intermediate to 9.5 with 10% aqu. NaOH. The final compositions for Examples 24–29 were composed of 92.5% of the Intermediate for each Example and 7.5% of n-Butane. These compositions were packaged in aerosol containers as described in Examples 1–3.

The Intermediates for Examples 30–37 were blends of the Intermediates of Examples 24–29:

The Intermediate for Example 30 was a 1:1 blend of the Intermediates for Examples 24 and 26.

The Intermediate for Example 31 was a 1:1 blend of the Intermediates for Examples 24 and 28.

The Intermediate for Example 32 was a 1:1 blend of the Intermediates for Examples 25 and 27.

The Intermediate for Example 33 was a 1:1 blend of the Intermediates for Examples 25 and 29.

The Intermediate for Example 34 was a 1:1 blend of the Intermediates for Examples 26 and 28.

The Intermediate for Example 35 was a 1:1 blend of the Intermediates for Examples 27 and 29.

The Intermediate for Example 36 was a 1:1:1 blend of the Intermediates for Examples 24, 26 and 28.

The Intermediate for Example 37 was a 1:1:1 blend of the Intermediates for Examples 25, 27 and 29.

The final compositions for Examples 30–37 were composed of 92.5% of the Intermediate for each Example and 7.5% of n-Butane. These compositions were packaged in aerosol containers as described in Examples 4–7.

To conduct the Soiling Capsule Test, a nylon fabric test panel was divided into 5 marked sections. In addition to Examples 24–37, commercially available fabric shampoo compositions were also included in this test: PROFONDEUR, Henkel PPZ, GLORY® Rug Cleaner, and Henkel PPZ of Example 13, WOOLITE® Tapis Moquette from Reckitt & Colman, SAPUR from Thompson GmbH of Dusseldorf, Germany, TUBA from Erdal GmbH of Hallein, Germany, and EXPRESS POUDRE from La Johnson Francaise S. A. Each composition to be tested was sprayed into a marked section for a standard length of time so that the section was evenly covered with the foam shampoo composition. The foam shampoo composition was scrubbed into the section by hand and left to dry at room temperature for about 26 hours. One section on each panel was not cleaned (BLANK) to act as a control. The dry panel was then subjected to the Soiling Capsule Test.

The results of the Soil Capsule Test are reported in Table IV by ranking the cleanest sample as 1, the next cleanest as 2, and so forth up to 5 as the dirtiest of the five sections. As in Example 13, the order of listing of the compositions in Table IV relates to their position on the carpet panel.

TABLE IV

| Composition: | Ranking: | Composition: | Ranking: |
|---|---|---|---|
| PROFONDEUR | 5 | Example 29 | 3 |
| Example 24 | 2 | SAPUR | 4 |
| BLANK | 1 | BLANK | 1 |
| SAPUR | 4 | PROFONDEUR | 5 |
| Example 27 | 3 | Example 30 | 2 |
| SAPUR | 4 | Example 34 | 3 |
| PROFONDEUR | 5 | SAPUR | 4 |
| BLANK* | 2 | BLANK | 1 |
| Example 31* | 3 | Example 33 | 2 |
| Example 32* | 1 | PROFONDEUR | 5 |
| Example 36 | 2 | PROFONDEUR | 5 |
| PROFONDEUR | 5 | Example 37 | 2 |
| BLANK | 1 | BLANK | 1 |
| Example 35 | 3 | SAPUR | 4 |
| SAPUR | 4 | Example 24 | 3 |
| Henkel PPZ | 2 | TUBA | 2 |
| PROFONDEUR | 5 | PROFONDEUR | 5 |
| BLANK | 1 | BLANK | 1 |
| Example 24 | 4 | Example 24 | 3 |
| WOOLITE ® Tappis Moquette | 3 | GLORY ® Rug Cleaner | 4 |
| PROFONDEUR | 5 | BLANK | 1 |
| BLANK | 2 | Example 30 | 4 |
| SAPUR | 3 | Example 31 | 5 |
| Example 24 | 4 | Example 32 | 2 |
| EXPRESS POUDRE | 1 | Example 33 | 3 |
| BLANK | 1 | | |
| Example 34 | 5 | | |
| Example 35 | 3 | | |
| Example 36 | 4 | | |
| Example 37 | 2 | | |

*All three starred compositions were very close.

For Examples 24, 27 and 29, the results for one material of the three required by the present invention were poor. For Examples 30–35, the results were better. Examples 36–37 were generally the best of the compositions tested. The commercial products tested generally were not as good as the other shampoo compositions tested.

That which I claim is:

1. An improved fabric cleaning shampoo composition which leaves a powdery product which can be vacuumed away when dry comprising an effective amount of at least one surfactant selected from the group consisting of anionic, nonionic, amphoteric and zwitterionic surfactants which are suitable for shampooing a fabric and being substantially vacuumed away when dry which surfactant is dispersed in water at a pH of from about 7 to about 10.5, the composition being in an aqueous, liquid form, wherein the improvement comprises A. from about 0.5 to about 20% by weight of the total composition of a fabric cleaning polymer which is normally solid at 25° C. and is water soluble or water dispersible upon neutralization with an alkaline compound;

B. from about 0.1 to about 10% by weight of the total composition of a wax having a melting point of at least 50° C. selected from the group consisting of a natural wax, an oxidized polyethylene wax and an oxidized polypropylene wax;

C. from about 0.05% to about 5% by weight of the total composition of a silicone betaine polymer selected from the group consisting of;

i. polymers having the general formula $$R^2(R^1)_2SiO((R^1)_2SiO)_x(R^2R^1SiO)_ySi(R^1)_2R^2$$

wherein each x has a value of from 0 to 200; each y has a value of from 1 to 50; each $R^1$ may represent the same or different groups in the molecule but must be an alkyl radical with 1 to 18 carbon atoms, an aryl radical, or a polyoxyalkylene radical wherein at least 70% of the $R^1$ radicals are methyl radicals; $R^2$ may be the same as $R^1$; and at least one $R^2$ radical is selected from the group consisting of a. $—(CH_2)_3OCH_2CHR_3CH_2R_4$ groups, in which $R^3$ and $R^4$ are different, one radical representing a hydroxyl group and the other representing the $—N^+R^5R^6(CH_2)_nCOO^-$—group in which each $R^5$ and $R^6$ may be the same or different and each represents an alkyl radical with 1 to 4 carbon atoms or a benzyl radical, and n–1, 2 or 3, and b. $—R^7CONHR^8N+R^5R^6(CH_2)_nCOO^-$—groups, in which $R^7$ is a divalent alkylene radical with 2 to 12 carbon atoms, $R^8$ is a divalent alkylene radical with 2 to 6 carbon atoms, and $R^5$, $R^6$ and n are as above; and ii. silicone sulfobetaine polymers.

2. The fabric cleaning shampoo composition of claim 1 wherein the surfactant is present in an amount of from about 0.5% to about 20% by weight of the total composition.

3. The fabric cleaning shampoo composition of claim 2 wherein the surfactant is present in an amount of from about 0.5% to about 4%, the fabric cleaning polymer is present in an amount of from about 0.5% to about 4%, the wax is present in an amount of from about 0.5% to about 2%, and the silicone betaine polymer is present in an amount of from about 0.25% to about 0.5%.

4. The fabric cleaning shampoo composition of claim 1 wherein the surfactant is selected from the group consisting of anionic surfactants, amphoteric surfactants and zwitterionic surfactants and is present in an amount of from about 0.5% to about 4%.

5. The fabric cleaning shampoo composition of claim 1 wherein the fabric cleaning polymer is selected from the group consisting of at least one polymer of (a) a minor amount of an unsaturated carboxylic-acid functional monomer selected from the group consisting of acrylic acid, methacrylic acid, maleic anhydride, maleic acid, and itaconic acid and (b) a major amount of at least one unsaturated organic monomer selected from the group consisting of alkyl acrylates containing from 4 to 14 carbons, alkyl methacrylates containing from 5 to 15 carbons, styrene, alpha-methyl styrene, acrylonitrile, methacrylonitrile, and 1-alkenes having from 2 to 30 carbon atoms, wherein a minor amount is an amount equal to from about 2% to about 40% of the total polymer, and a major amount is an amount with respect to any particular polymer in excess of the minor amount of unsaturated carboxylic-acid functional monomer present.

6. The fabric cleaning shampoo composition of claim 1 wherein the wax is in the form of an aqueous emulsion of particles and is selected from the group consisting of pressure-emulsified, oxidized polyethylene wax and pressure-emulsified oxidized polypropylene wax having a melting point of at least 100° C.

7. The fabric cleaning shampoo composition of claim 1 wherein the silicone betaine polymer is of the general formula $$R^2(R^1)_2SiO((R^1)_2SiO)_x(R^2R^1SiO)_ySi(R^1)_2R^2$$

wherein each $R^1$ is an alkyl radical with 1 to 18 carbon atoms, an aryl radical or a polyoxyalkylene radical wherein at least 70% of the $R^1$ radicals are methyl radicals, $R^2$ may be the same as $R^1$ wherein at least one $R^2$ radical is selected from one of the group consisting of (I)

$$—(CH_2)_3OCH_2CHR^3CH_2R^4 \text{ groups}$$

in which $R^3$ and $R^4$ are different, one radical representing a hydroxyl group and the other represents the $$—N^+R^5R^6(CH_2)_nCOO^- \text{ group}$$

in which each $R^5$ and $R^6$ represents an alkyl radical with 1 to 4 carbon atoms or a benzyl radical, and n=1, 2 or 3, and (II)

$$—R^7CONHR^8N^+R^5R^6(CH_2)_nCOO^- \text{ groups}$$

in which $R^7$ is a divalent alkylene radical with 2 to 12 carbon atoms, $R^8$ is a divalent alkylene radical with 2 to 6 carbon atoms, each x has a value of from 0 to 200, and y has a value of from 1 to 50.

8. The fabric cleaning shampoo composition of claim 7 wherein the silicone betaine polymer is of the general formula $$(CH_3)_3SiO(SiACH_3O)_m(Si(CH_3)_2O)_nSi(CH_3)_3$$

wherein A has the formula $$—(CH_2)_3OCH_2CH(OH)CH_2N^+(CH_3)_2CH_2COO^-,$$

m and n are each greater than 0, the sum of m+n being such that the viscosity of the polymer at 25° C. is from about 50–90 square meters per second, its specific gravity at 25° C. is from about 1.07 to 1.09 grams per cubic centimeter, and the Ross Miles foam height of the polymer at 0.1% solution in water 8 dH, at 25° C. is 80.

9. The fabric cleaning shampoo composition of claim 5, wherein the fabric cleaning polymer is a polymer of methacrylic acid, styrene and n-butyl acrylate, and optionally, alpha-methyl styrene.

10. An improved fabric cleaning shampoo composition which leaves a powdery product which can be vacuumed away when dry comprising from about 0.5% to 10% of at least one surfactant selected from the group consisting of anionic, nonionic, amphoteric and zwitterionic surfactants which are suitable for shampooing a fabric and being substantially vacuumed away when dry which surfactant is dispersed in water at a pH of from about 7 to about 10.5, the composition being in an aqueous liquid form wherein the improvement comprises a) from about 0.5 to about 10% by weight of the total composition of a fabric cleaning polymer which is normally solid at 25° C. and is water soluble or water dispersible upon neutralization with an alkaline compound which is selected from the group consisting of at least one polymer of (a) from about 2% to 40% by weight of the total polymer of an unsaturated carboxylic-acid functional monomer selected from the group consisting of acrylic acid, methacrylic acid, maleic anhydride, maleic acid, and itaconic acid and (b) from about 60% to 98% by weight of the total polymer of at least one unsaturated organic monomer selected from the group consisting of alkyl acrylates containing from 4 to 14 carbons, alkyl methacrylates containing from 5 to 15 carbons, styrene, alpha-methyl styrene, acrylonitrile, methacrylonitrile, and 1-alkenes having from 2 to 30 carbon atoms;

b) from about 0.1 to about 10% by weight of the total composition of a wax selected from the group consisting of oxidized polyethylene wax and oxidized polypropylene wax having a melting point of at least 100° C.; and c) from about 0.05% to about 5% by weight of the total composition of a compatible silicone betaine polymer wherein the silicone betaine polymer is of the general formula $$R^2(R^1)_2SiO((R^1)_2SiO)_x(R^2R^1SiO)_ySi(R^1)_2R^2$$

wherein each $R^1$ is an alkyl radical with 1 to 18 carbon atoms, an aryl radical or a polyoxyalkylene radical wherein at least 70% of the $R^1$ radicals are methyl radicals, $R^2$ may be the same as $R^1$ wherein at least one $R^2$ radical is selected from one of the group consisting of (I)

$$—(CH_2)_3OCH_2CHR^3CH_2R^4 \text{ groups}$$

in which $R^3$ and $R^4$ are different, one radical representing a hydroxyl group and the other represents the $$—N^+R^5R^6(CH_2)_nCOO^- \text{ group}$$

in which each $R^5$ and $R^6$ represents an alkyl radical with 1 to 4 carbon atoms or a benzyl radical, and n=1, 2 or 3, and (II)

$$—R^7CONHR^8N^+R^5R^6(CH_2)_nCOO^- \text{ groups}$$

in which $R^7$ is a divalent alkylene radical with 2 to 12 carbon atoms, $R^8$ is a divalent alkylene radical with 2 to 6 carbon atoms, each x has a value of from 0 to 200, and y has a value of from 1 to 50.

11. The fabric cleaning shampoo composition of claim 10 wherein the surfactant is present in an amount of from about 0.5% to about 4%, the fabric cleaning polymer is present in an amount of from about 0.5% to about 4%, the wax is present in an amount of from about 0.5% to about 2%, and the silicone betaine polymer is present in an amount of from about 0.25% to about 0.5%.

12. The fabric cleaning shampoo composition of claim 11 wherein the surfactant is selected from the group consisting of anionic surfactants, amphoteric surfactants and zwitterionic surfactants.

13. The fabric cleaning shampoo composition of claim 12 wherein the wax is in the form of an aqueous emulsion of particles and is a pressure-emulsified oxidized polyethylene having a melting point of at least 100° C.

14. The fabric cleaning shampoo composition of claim 13 wherein the fabric cleaning polymer is a polymer of methacrylic acid, styrene and n-butyl acrylate, and optionally, alpha-methyl styrene.

15. The fabric cleaning shampoo composition of claim 14 wherein the silicone betaine polymer is of the general formula $$(CH_3)_3SiO(SiACH_3O)_m(Si(CH_3)_2O)_nSi(CH_3)_3$$

wherein A has the formula $$—(CH_2)_3OCH_2CH(OH)CH_2N^+(CH_3)_2CH_2COO^-,$$

m and n are each greater than 0, the sum of m+n being such that the viscosity of the polymer at 25° C. is from about 50–90 square meters per second, its specific gravity at 25° C. is from about 1.07 to 1.09 grams per cubic centimeter, and the Ross Miles foam height of the polymer at 0.1% solution in water 8 dH, at 25° C. is 80.

* * * * *